United States Patent [19]

Itemadani et al.

[11] 4,411,362

[45] Oct. 25, 1983

[54] ASSEMBLY DEVICES FOR ELECTRONIC CIRCUIT COMPONENTS

[75] Inventors: Eiji Itemadani, Sakai; Kazuhiro Mori, Katano; Sohei Tanaka, Neyagawa; Akira Kabeshita, Moriguchi, all of Japan

[73] Assignee: Matsushita Electric Industrial Co., Ltd., Kadoma, Japan

[21] Appl. No.: 405,105

[22] Filed: Aug. 4, 1982

[30] Foreign Application Priority Data

Aug. 11, 1981 [JP] Japan ..... 56-125654

[51] Int. Cl.[3] ..... B65D 73/02; B65D 75/22

[52] U.S. Cl. ..... 206/330; 206/460

[58] Field of Search ..... 206/328, 330, 332, 460, 206/443

[56] References Cited

U.S. PATENT DOCUMENTS

| | | | |
|---|---|---|---|
| 3,211,503 | 10/1965 | Barnes | 206/328 |
| 3,465,874 | 9/1969 | Hoale et al. | 206/330 |
| 3,645,281 | 2/1972 | Seidler | 206/328 |
| 3,695,414 | 10/1972 | Wiesler et al. | 206/328 |
| 3,731,254 | 5/1973 | Key | 206/328 |
| 4,298,120 | 11/1981 | Kaneko et al. | 206/460 |

*Primary Examiner*—Joseph Man-Fu Moy

*Attorney, Agent, or Firm*—Cushman, Darby & Cushman

[57] ABSTRACT

Assembly devices for electrical circuit components which is suitable for feeding electronic chip components, especially for semiconductor IC chips with comb-like leads, to e.g. chip mounting apparatuses, comprises two belt-like long objects made of tape-like and belt-shaped long materials, and is capable of feeding the electronic chip components mounted thereon in a stable and continuous feeding operation.

8 Claims, 12 Drawing Figures

ASSEMBLY DEVICES FOR ELECTRONIC CIRCUIT COMPONENTS

BACKGROUND OF THE INVENTION

1. Field of the Invention

The present invention relates to assembly devices for electrical circuit components suitable for supplying electronic chip components, especially chip components with comb-like leads, to e.g. chip mounting apparatuses.

2. Description of the Prior Art

Conventionally, the following methods and apparatuses have been employed to feed IC chip components of relatively small sizes to mounting machines for depositing the IC chip components onto predetermined places on electrical circuit boards. As some examples of such IC chip components (hereinafter referred to as electronic components), a flat package IC 100 and a mini-package IC or SO (small outline) IC 102 are shown with comb-like leads 101, 103 in FIG. 1 and FIG. 2, respectively.

As known bowl type work-feeder 104 combined with a known in-line type work-feeder 105 is shown in FIG. 3. Electronic components 106 are successively fed in a row by these feeders suitably fixed on a workable (not shown). FIG. 4 shows a portion of another conventional assembly device 107 of magazine type. Electronic components 102' are fed one by one inside a rectangular column in a horizontal direction thereof.

FIG. 5 shows a portion of still another conventional assembly device of carrier magazine type. It corresponds to the case where a casing 108 is made of e.g. plastics and has encaved recesses 109. The recesses 109 are formed at a uniform interval and used for carrying electronic components stored therein.

FIG. 6 shows a carrier type 110 provided with a plurality of sprocket holes 111 and openings 112. Electronic components placed inside the openings 112 closed by an upper tape 113 and a bottom tape 113', are carried by use of the sprocket holes 111.

Feeding operations by employing the above four conventional assembly devices have the following drawbacks.

In the case of FIG. 3, the bowl type and in-line type work-feeders 104 and 105 feed the electronic components 106 by vibration, thereby resulting in shortcomings that the vibration adversely affects other portions of the assembly machine, that large spaces are necessary for installing several work-feeders at the assembly machine, and further that the electronic components 106 are liable to be stuck partly due to bending of their comb-like leads during feeding through a chute of the in-line type workfeeder 105.

In the case of FIG. 4, the electronic components 102' are indexed by suitable pushing means (not shown). The index is made with a relatively high reliability. But, the magazine method has shortcomings that it takes much time to restore the machine operation when the electronic components 102' are stuck, and that the number of the electronic components 102' stocked in one column magazine is generally limited.

Further, in the case of FIG. 5, although a stable feeding operation is obtainable, the feeding method by use of the carrier magazine 108 has another shortcomings that a relatively large size is necessary for the carrier magazine 108 in comparison with small sizes of the electronic components, and that large spaces and a complex feeding machine are necessary for automatically feeding the carrier magazines 108.

And further, in the case of FIG. 6, although a stable feeding operation is obtainable, the feeding method by use of the carrier tape 110 with the openings 112 has still another shortcomings that, when the electronic components are taken out from the openings 112 one by one, their comb-like leads are liable to touch the walls of the openings 112 thus obstructing their taking out operations, and further that even if the stuck electronic components could be taken out, the comb-like leads would be frequently deformed, so that they could not be deposited correctly on circuit boards.

SUMMARY OF THE INVENTION

The present invention provides assembly devices for electronic components made of tape-like and belt-shaped long materials, on which electronic components are mounted. The electronic components mounted at a uniform and/or a non-uniform interval can be continuously and stably carried without the above-mentioned conventional problems.

DESCRIPTION OF THE PREFERRED EMBODIMENTS

The present invention provides an assembly device for electronic components comprising:

- a first belt-like long object having a first face and a second face, and provided with a plurality of openings at predetermined intervals, and
- a second belt-like long object disposed on the second face of the first belt-like long object,
- portions of the second belt-like long object at a plurality of the openings having faces coated with stucking or adhesive agent, the faces projecting above the plane of the first face for holding electronic components at the openings.

The assembly devices for electronic components embodying the present invention will be described by referring to the accompanied drawings.

Figure 7:
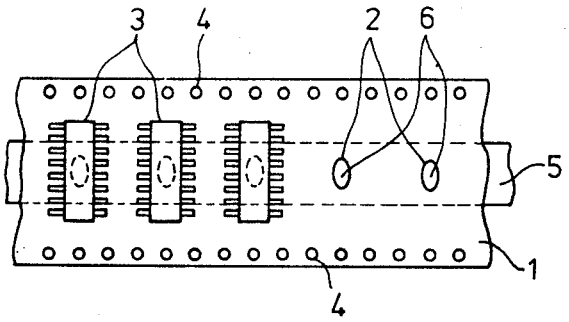
FIG. 7 is a top view of an assembly device for electronic components embodying the present invention.
Figure 8:
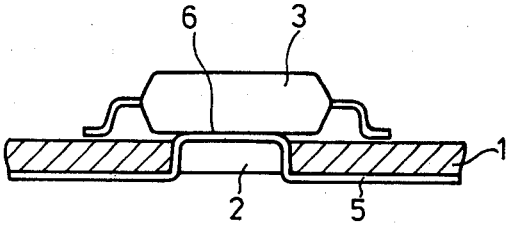
FIG. 8 is an elevational view in section of the same.

FIG. 7 shows an assembly device for electronic components, and FIG. 8 is an elevational view in section of the same. A belt-like long object (hereinafter referred to as tape) 1 made of e.g. paper of 0.3 mm in thickness is provided with a plurality of openings 2 at approximately central places in transverse directions across the tape 1. An adhesive belt-like long object (hereinafter referred to as adhesive tape) 5 made of e.g. paper of 0.15 mm in thickness is attached on one face of the tape 1. Portions 6 of the adhesive tape 5 at the openings 2 project above the plane of the top face of the tape 1 as shown in FIG. 8. Electronic components 3 are attached and held to the portions 6 by the adhesive agent. The tape 1 is also provided with a plurality of sprocket holes 4 on both sides thereof at a specified interval correlated with an interval of the openings 2. The sprocket holes 4 and the openings 2 may be formed at a uniform or non-uniform intervals.

Figure 1:
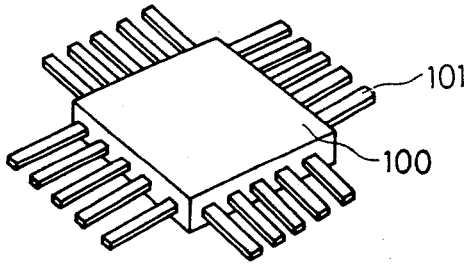
FIG.1 (Prior Art)
FIG. 1 is the perspective view of the flat package IC with comb-like leads.
Figure 2:
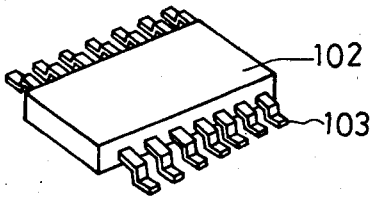
FIG.2 (Prior Art)
FIG. 2 is the perspective view of the minipackage IC or SO IC with comb-like leads.
Figure 3:
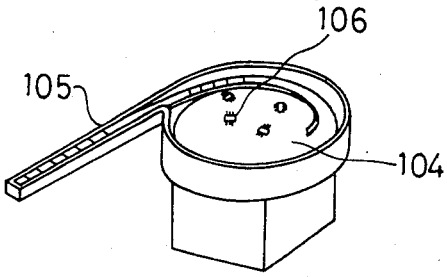
FIG.3 (Prior Art)
FIG. 3 is the perspective view of a known bowl type work-feeder combined with the known in-line type work-feeder.
Figure 4:
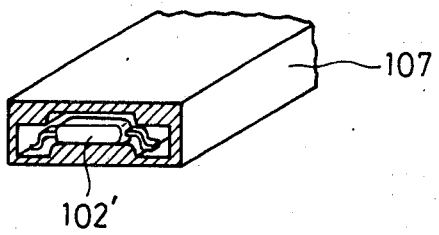
FIG. 4 (Prior Art)
FIG. 4 is the sectional view showing the portion of another conventional assembly device of magazine type.
Figure 5:
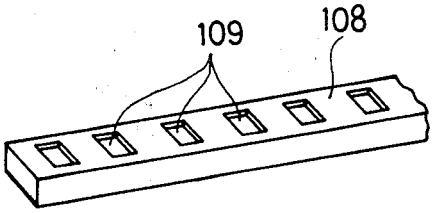
FIG. 5 (Prior Art)
FIG. 5 is the perspective view showing the portion of still another conventional assembly device of carrier magazine type.
Figure 6:
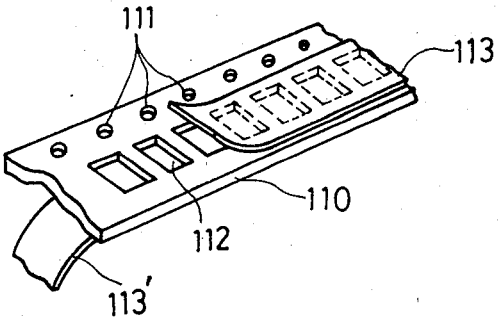
FIG. 6 (Prior Art)
FIG. 6 is the perspective view showing the carrier tape provided with the plurality of openings for carrying electronic components deposited therein.

The assembly device shown in FIG. 7 and FIG. 8 has features that necessary spaces for storing the electronic components are not large, once the tape 1 and the adhesive tape 5 are wound around a reel, and that a plurality of the electronic components 3 can be fed continuously with a relatively high reliability, by use of the sprocket holes 4. Since the electronic components 3 is not covered, contrary to the case of FIG. 6, it is easy to remove them from the portions 6 by suction or mechanical means so that they can securely be deposited one by one on desired places. In addition, since the adhesive portions 6 project above the plane of the top face of the tape 1, comb-like leads of the electronic components 3 do not touch the top surface of the tape 1 in the condition that the electronic components 3 are adhered to the adhesive portions 6. Therefore, there is no fear that the comb-like leads are deformed when the electronic components 3 are attached to the adhesive portions 6. This results in a further advantageous feature that a correct and stable feeding operation can be expected in depositing the electronic components 3 onto desired objects.

Figure 9:
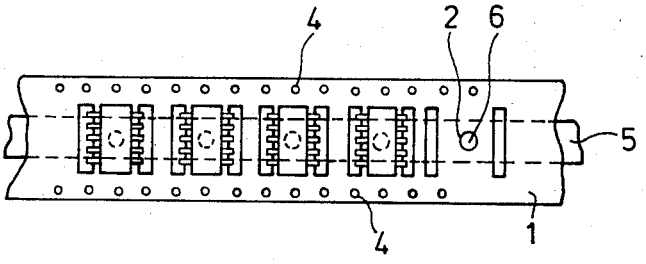
FIG. 9 is a top view of another assembly device for electronic components embodying the present invention.
Figure 10:
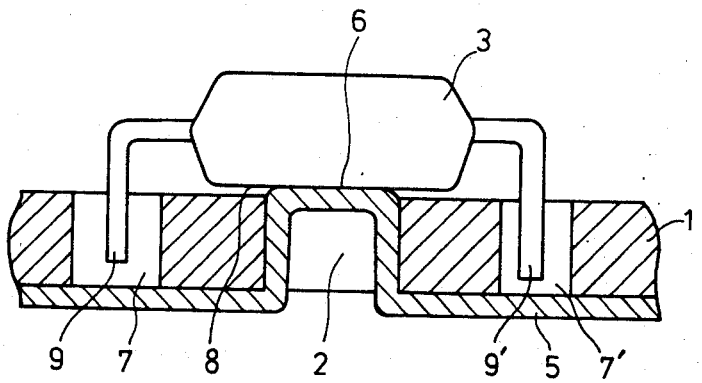
FIG. 10 is an elevational view in section of the same.

Another assembly device embodying the present invention is shown in FIG. 9, and FIG. 10 is an elevational view in section of the same. In this case, in addition to a plurality of openings 2 formed on a tape 1, a plurality of recesses or through-holes 7, 7' are also formed on the tape 1. The openings 2 are used for projecting an adhesive tape 5 at the openings 2 so as to result in adhesive portions 6, and through-holes 7, 7' are formed for receiving comb-like leads 9, 9' of the electronic components 3. The tape 1 is also provided with a plurality of sprocket holes 4 on both sides thereof at a specified interval correlated with an interval of the openings 2. The sprocket holes 4 and the openings 2 may be formed at a uniform or non-uniform intervals.

By employing the assembly device shown in FIG. 9 and FIG. 10, even if the comb-like leads 9, 9' extend downwards below the plane of the lower face 8 of the electronic components 3, it is possible to feed the electronic components 3 without deforming the comb-like leads 9, 9' by selecting a suitable thickness for the tape 1 responding to the extended length of the comb-like leads 9, 9'. In addition, it is possible to use the tape 1 and the adhesive tape 5 with the respective same dimensions in common for different sizes of the electronic components 3, provided that sizes and dimensions of the comb-like leads 9, 9' are similar. Therefore, the assembly device shown in FIG. 9 and FIG. 10 is advantageous in its versatility.

Figure 11:
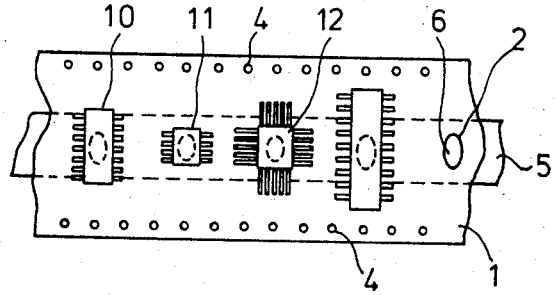
FIG. 11 is a top view of still another assembly device for electronic components embodying the present invention.
Figure 12:
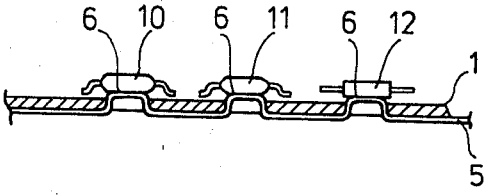
FIG. 12 is an elevational view in section of the same.

Still another assembly device embodying the present invention is shown in FIG. 11, and FIG. 12 is an elevational view in section of the same. In this case, although a tape 1 and an adhesive tape 5 are similar to those shown in FIG. 7 and FIG. 8, electronic components 10, 11, 12 . . . of different shapes and sizes are adhered to adhesive portions 6 in a predetermined order responding to an order of depositing operations. By employing the assembly device shown in FIG. 11 and FIG. 12, i.e. by suitably selecting shapes of the openings 2 taking into account of the shapes and sizes of the various electronic components 10, 11, 12, . . . , it is possible to feed them by a single pair of the tape 1 and the adhesive tape 5, and further in a specified order correlated with a deposition operation order. Therefore, in addition to the advantageous effects described above for the case of FIG. 7 and FIG. 8, the assembly device shown in FIG. 11 and FIG. 12 has an advantageous feature that an easy and efficient deposition of the components is realizable by use of a single assembling apparatus. It is further possible to modify the assembly device shown in FIG. 11 so as to provide with through-holes, like the case of FIG. 10, so that electronic components of different shapes and sizes, and with comb-like leads extending below can be fed simultaneously.

As described above, the present invention can provide stable and continuous feeding operations by employing the assembly devices for electronic components disclosed herein.

What is claimed is:

1. An assembly device for electronic small components comprising:

a first belt-like long object having a first face and a second face, and provided with a plurality of openings at predetermined intervals, and a second belt-like long object disposed on said second face of said first belt-like long object, portions of said second belt-like long object at said plurality of openings having adhesive faces which project above the plane of said first face by at least a predetermined height for attaching electronic chip components at said openings.

2. An assembly device in accordance with claim 1, wherein said first belt-like long object is provided with a plurality of sprocket holes in a lateral direction thereof.

3. An assembly device in accordance with claim 1, wherein said first belt-like long object is provided with a plurality of sprocket holes in two parallel lateral directions thereof.

4. An assembly device in accordance with claim 1, 2 or 3, wherein said first belt-like long object is adhered to an adhesive layer coated on said second belt-like long object.

5. An assembly device in accordance with claim 1, 2 or 3, wherein said first belt-like long object is further provided with a plurality of recesses for receiving leads of said electronic chip components on both sides of each one of said openings.

6. An assembly device in accordance with claim 4, wherein said first belt-like long object is further provided with a plurality of recesses for receiving leads of said electronic chip components on both sides of each one of said openings.

7. An assembly device in accordance with claim 1, 2 or 3, wherein said openings on said first belt-like long object are formed at a predetermined uniform interval.

8. An assembly device in accordance with claim 1, 2 or 3, wherein said openings on said first belt-like long object have different shapes and sizes.

* * * * *